US010897994B2

(12) United States Patent
Bowers

(10) Patent No.: US 10,897,994 B2
(45) Date of Patent: Jan. 26, 2021

(54) FITNESS EQUIPMENT STORAGE SYSTEM

(71) Applicant: Power Systems (PS), LLC, Chattanooga, TN (US)

(72) Inventor: Michael E. Bowers, Maryville, TN (US)

(73) Assignee: Power Systems (PS), LLC, Chattanooga, TN (US)

( * ) Notice: Subject to any disclaimer, the term of this patent is extended or adjusted under 35 U.S.C. 154(b) by 0 days.

(21) Appl. No.: 16/353,599

(22) Filed: Mar. 14, 2019

(65) Prior Publication Data

US 2019/0281978 A1 Sep. 19, 2019

Related U.S. Application Data

(60) Provisional application No. 62/642,978, filed on Mar. 14, 2018.

(51) Int. Cl.

| | |
|---|---|
| ***A47B 46/00*** | (2006.01) |
| ***A47B 53/02*** | (2006.01) |
| ***A47B 81/00*** | (2006.01) |
| ***A47B 96/20*** | (2006.01) |

(52) U.S. Cl.

CPC ..... *A47B 53/02* (2013.01); *A47B 81/00* (2013.01); *A47B 96/20* (2013.01)

(58) Field of Classification Search

CPC ..... A47B 53/02; A47B 81/00; A47B 96/20
See application file for complete search history.

(56) References Cited

U.S. PATENT DOCUMENTS

| | | | | | |
|---|---|---|---|---|---|
| 275,616 | A * | 4/1883 | Elward | A47B 53/02 | 312/200 |
| 1,241,615 | A * | 10/1917 | Farrow | E05G 1/00 | 109/23 |
| 2,043,728 | A * | 6/1936 | Besst, Jr. | E06B 7/28 | 312/275 |
| 2,643,171 | A * | 6/1953 | Sterba | A47B 61/00 | 312/287 |
| 4,129,346 | A * | 12/1978 | Hofman | A45C 5/00 | 312/244 |
| 4,240,222 | A * | 12/1980 | Covington | A01K 97/06 | 43/57.1 |
| 4,480,744 | A * | 11/1984 | Blackmon | A45C 5/00 | 206/1.7 |
| 4,978,001 | A * | 12/1990 | Nelson | A45C 11/16 | 206/6.1 |
| D372,607 | S * | 8/1996 | Pallas | D6/671.1 | |
| D440,429 | S * | 4/2001 | Wales | D6/671 | |
| 6,401,947 | B1 * | 6/2002 | Hu | A47B 61/00 | 211/186 |

(Continued)

*Primary Examiner* — Kimberley S Wright
(74) *Attorney, Agent, or Firm* — McAndrews, Held & Malloy, Ltd.

(57) ABSTRACT

The present disclosure is directed to systems for the storage of group exercise equipment. Embodiments of the system provide for the organized storage of one or more types of fitness equipment in a manner that provides easy access to the equipment while being configurable in a plurality of orientations so as to have a desired footprint for a small space, such as a fitness studio or gym. In some orientations the system may provide access to the stored fitness equipment while in other orientations the system may restrict access to the stored equipment.

15 Claims, 11 Drawing Sheets

(56) References Cited

U.S. PATENT DOCUMENTS

| | | | | |
|---|---|---|---|---|
| 7,712,849 | B2 * | 5/2010 | Jakins | A47B 83/001 312/310 |
| 7,841,676 | B2 * | 11/2010 | Hawkins | A47B 45/00 312/107 |
| 9,445,667 | B2 * | 9/2016 | McCuistion | A47B 53/02 |
| 9,451,823 | B2 * | 9/2016 | McCuistion | A47B 53/02 |
| 10,130,088 | B2 * | 11/2018 | Dollahite | A01K 97/06 |
| 2004/0100173 | A1 * | 5/2004 | Jakob-Bamberg | A47B 88/42 312/330.1 |
| 2008/0042530 | A1 * | 2/2008 | Hawkins | A47B 45/00 312/199 |
| 2008/0252189 | A1 * | 10/2008 | Regan | A47B 81/00 312/249.8 |
| 2011/0025181 | A1 * | 2/2011 | Vinke | A47B 57/20 312/257.1 |
| 2011/0074256 | A1 * | 3/2011 | Boice | A47B 81/00 312/213 |
| 2016/0166057 | A1 * | 6/2016 | Hubert | B25H 1/04 312/237 |
| 2016/0198845 | A1 * | 7/2016 | McCuistion | A47B 53/02 211/86.01 |
| 2016/0198846 | A1 * | 7/2016 | McCuistion | A47B 53/02 211/150 |
| 2018/0049420 | A1 * | 2/2018 | Dollahite | A01K 97/06 |

* cited by examiner

FITNESS EQUIPMENT STORAGE SYSTEM

The present application claims priority to U.S. provisional patent application No. 62/642,978, filed Mar. 14, 2018, the entirety of which is incorporated by reference herein.

BACKGROUND

The presently disclosed invention is directed to a storage system configured to for the organization and storage of fitness equipment.

Because group fitness activities, such as instructor-led classes, are an increasingly popular form of exercise, many different businesses offer some form of group fitness activity. These businesses include large commercial gyms, smaller studio fitness centers, and fitness centers solely dedicated to one or more specific group fitness activities. Many group fitness activities require the use of specialized equipment, meaning that a business must maintain and store such equipment so as to be easily accessible to its customers. The storage of fitness equipment, however, takes up valuable exercise space. Additionally, where multiple types of fitness equipment are stored in a single area, it is easy for the equipment to become disorganized, hindering access to that equipment. Finally, where the space is used for activities other than group fitness activities, it may be fairly easy for a person to walk off with the fitness equipment.

SUMMARY

Embodiments of the fitness equipment storage system of the present disclosure provide an improved storage solution that allows for the organized storage of one or more types of fitness equipment in a manner that both (a) effectively utilizes a variety of small spaces and (b) provides easy access to the equipment. As illustrated in the attached drawings, the fitness equipment storage system of the present disclosure is positionable in multiple orientations to provide and/or restrict access to the equipment while overcoming various potential spatial limitations. Embodiments of the storage system may also be made of an easily cleanable and sterile material, such as metal (other embodiments may be made of wood or plastic), and may contain a plurality of apertures, e.g. perforations, in order to both (a) provide airflow within the various storage compartments and (b) allow users to see the equipment stored within each of the various storage compartments.

Some embodiments of the fitness equipment storage system of the present disclosure may comprise one or more storage compartments configured to store a plurality of dumbbells. Some embodiments of the fitness equipment storage system of the present disclosure may comprise one or more storage compartments configured to store a plurality of resistance bands, jump ropes, resistance tubing, and/or other hanging fitness accessories. Some embodiments of the fitness equipment storage system of the present disclosure may comprise one or more storage compartments configured to store a plurality of exercise mats. Some embodiments of the fitness equipment storage system of the present disclosure may comprise one or more storage compartments configured to store a plurality of boxing gloves or other small fitness accessories.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION

Figure 1:
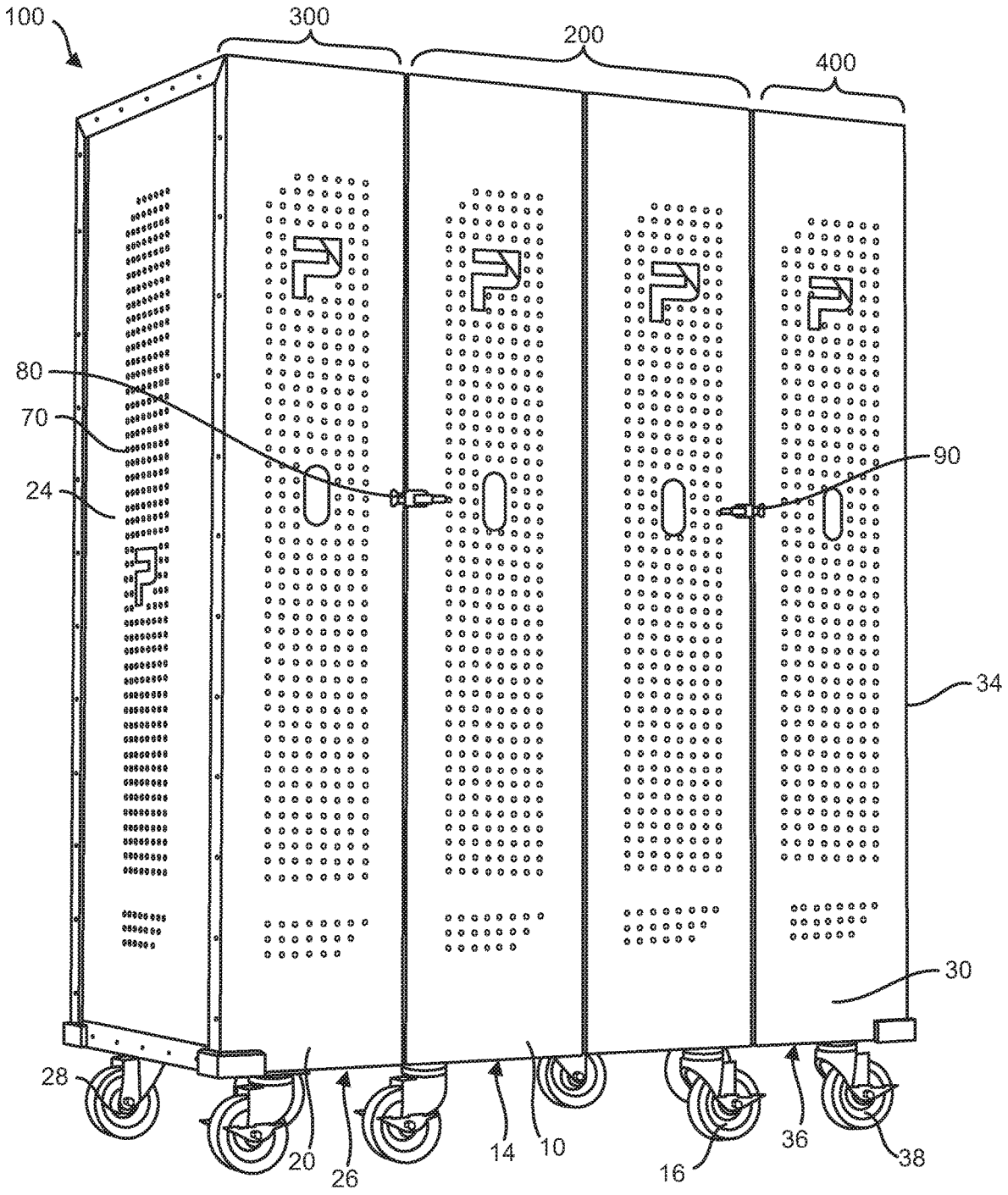
FIG. 1 is a front, left side perspective view of an embodiment of the fitness equipment storage system disclosed herein, in which each of the first and second side units is in a first position.

Embodiments of the present disclosure are directed to an improved fitness equipment storage system.

FIGS. 1 through 6 show a fitness equipment storage system 100 of an embodiment of the invention. The storage system 100 has a central unit 200 having a front wall 10, a rear wall 12, a bottom wall 14 having one or more wheels 16, a top wall 17, and one or more interior walls 18. The central unit defines a first storage compartment 500 open to a first side of the central unit and a second storage compartment 600 open to a second side of the central unit.

The storage system 100 further comprises a first side unit 300 having a front wall 20, a rear wall 22, an outer side wall 24, a bottom wall 26 having one or more wheels 28, and a top wall 27. The walls of the first side unit 300 define a third storage compartment 700. The rear wall 22 of the first side unit 300 is hingedly connected to the central unit 200, such that the first side unit 300 is movable with respect to the central unit.

The storage system 100 further comprises a second side unit 400 having a front wall 30, a rear wall 32, an outer side wall 34, a bottom wall 36 having one or more wheels 38, and a top wall 37. The walls of the second side unit 400 define a fourth storage compartment 800. The rear wall 32 of the second side unit 400 is hingedly connected to the central unit 200, such that the second side unit 400 is movable with respect to the central unit.

Figure 2:
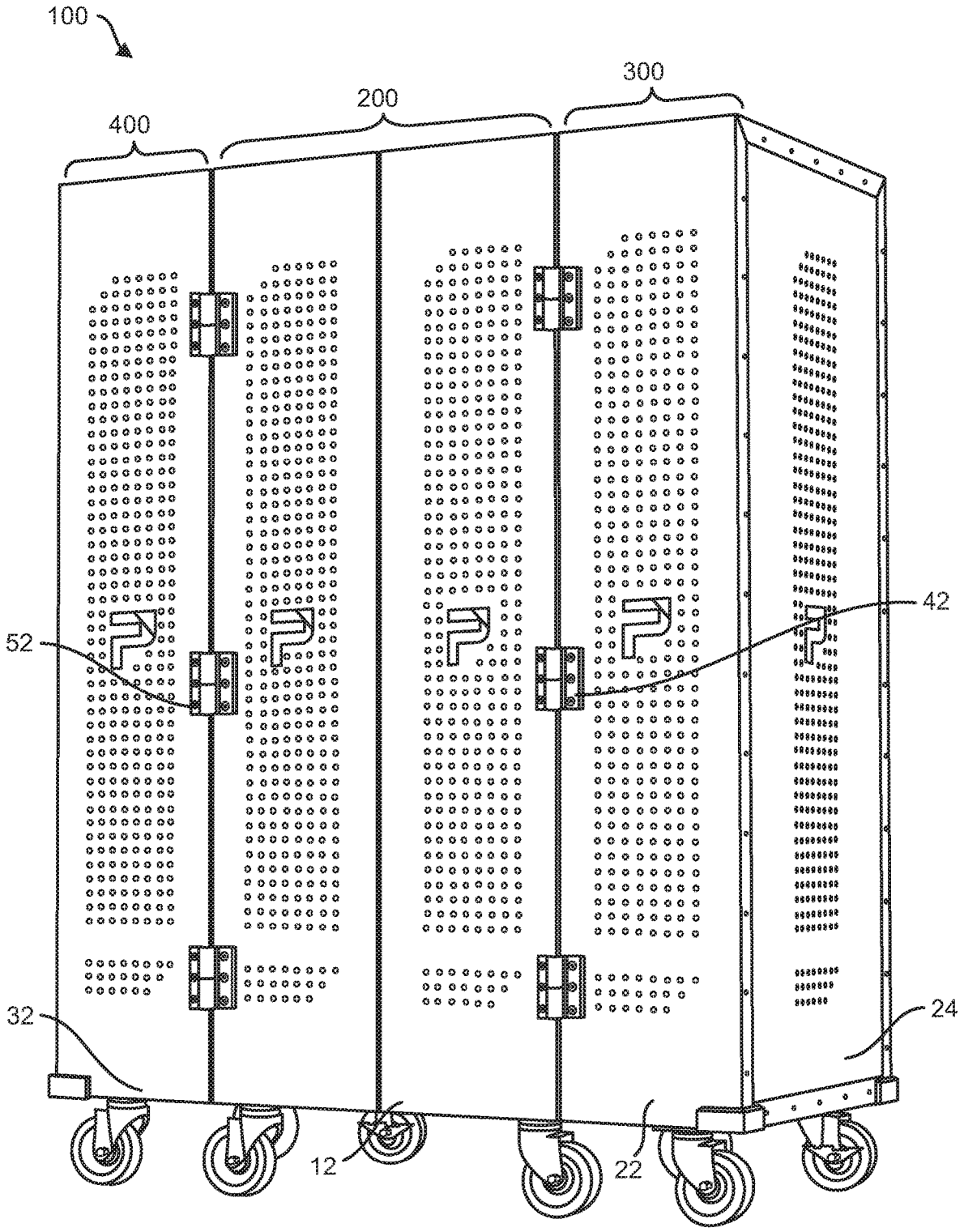
FIG. 2 is a rear, left side perspective view of an embodiment of the fitness equipment storage system disclosed herein, in which each of the first and second side units is in a first position.

FIG. 2 shows the embodiment of a fitness equipment storage system 100 of FIG. 1 in a rear view. As shown, the rear wall 22 of the first side unit 300 is hingedly connected, e.g. via hinges 42, to a first side of the rear wall 12 of the central unit 200, such that the first side unit 300 is rotatable about the hinges 42. The rear wall 32 of the second side unit 400 is hingedly connected, e.g. via hinges 52, to a second side of the rear wall 12 of the central unit 200, such that the second side unit 400 is rotatable about the hinges 52. In some embodiments, each of the front walls 20,30 and rear walls 22,32 of the first side unit 300 and second side unit 400 are about half as wide as the front wall 10 and rear wall 12 of the central unit 200.

In some embodiments, wheels may be included in the fitness equipment storage system 100 in order to more easily move the system. The wheels also help in moving the first side unit 300 and second side unit 400 to various positions by rotation about hinged connections between each of the first and second side unit with central unit 200. In some embodiments, for instance, the central unit 200 may have four wheels 16, the first side unit 300 may have two wheels 28, and the second side unit 400 may have two wheels 38. In other embodiments, however, the central unit 200 and the first and second side units 300, 400 may have differing numbers of wheels.

In some embodiments, one or more of the wheels may be mounted so that the axis of the wheel may be rotatable 360 degrees. In other embodiments, the wheels may be mounted so that the axis of the wheel is fixed or substantially fixed. In some embodiments, one or more of the wheels may comprise a locking mechanism, which when activated prevents the one or more wheels from spinning. For instance, one or more of the wheels may comprise a foot-operated wheel lock.

In some embodiments, the walls of the fitness equipment storage system 100 can each be made of metal. Providing the storage system 100 with metal walls provides benefits in terms of being easy to clean and as being resistant to, e.g. not absorbing, moisture (e.g. sweat) and/or odors from exercise equipment stored within the storage compartments. In other embodiments, however, the walls can be made of wood or plastic materials. In some embodiments, all walls of each of the central unit 200, the first side unit 300, and the second side unit 400 may be metal.

In some embodiments, one or more walls of the fitness equipment storage system 100 may contain a plurality of apertures 70 in order to provide airflow within the various storage compartments within each of the various storage compartments. Airflow is particularly important for the storage of fitness equipment, as it allows for the evaporation of moisture and dissipation of odors from the equipment. Without any such apertures 70, for instance, moisture and odor may become trapped within the storage compartments causing degradation of the equipment and an unpleasant user experience. Depending on how they are configured and arranged, apertures 70 may also provide visibility into a storage compartment even when that storage compartment is closed/inaccessible. Accordingly, a user may be able to determine which storage compartment contains a desired piece or set of equipment without having to open any of the compartments.

The apertures 70 can be located on any of the walls of the storage system. For instance, in the embodiment illustrated in FIGS. 1 through 6 the front walls and the rear walls of each of the central unit 200, first side unit 300, and second side unit 400 have a plurality of apertures 70. As illustrated, the outer side wall 24 of the first side unit 300 and the outer side wall 34 of the second side unit 400 each also have a plurality of apertures 70. In other embodiments, however, apertures 70 may be located on fewer walls than that in the illustrated embodiment.

In some embodiments, including for example the embodiment illustrated in FIGS. 1-6, apertures 70 may comprise a plurality of small perforations in the metal walls. However, the apertures 70 may take on any number of forms, have any desired shape and size, etc. In some embodiments, the apertures 70 may be located along at least 50% of the height of the walls, alternatively at least 75% of the height of the walls. In the illustrated embodiment, for example, apertures 70 are located along at least 75% of the height of the front walls, the rear walls, and the two outer side walls.

In some embodiments, the fitness equipment storage system 100 may further comprise latches 80,90 to keep the side units stationary and secure the storage system in a closed and optionally locked position which can be used to restrict access to the equipment when necessary. For instance, the front wall 20 of the first side unit 300 may have a first latching element 82 and the front wall 10 of the central unit 200 may have a second latching element 84, the first and second latching elements 82,84 being configured to mate so as to prevent movement of the first side unit away from the central unit. Similarly, the front wall 30 of the second side unit 400 may have a first latching element 92 and the front wall 10 of the central unit 200 may have a second latching element 94, the first and second latching elements 92,94 being configured to mate so as to prevent movement of the second side unit away from the central unit.

In some embodiments, one or more of the latches may further comprise a locking element, such as a key lock, an opening configured to receive a padlock, a combination lock, or the like. In that way, an operator of a gym or fitness studio may easily lock the storage system to protect the fitness equipment when the equipment is not in use. Because of the unique way in which the storage compartments are closed, all four storage compartments may be locked through the use of two locking elements.

The fitness equipment storage system 100 is configured so that it can be placed in a variety of orientations. As shown in FIGS. 1 through 6, for example, each of the first side unit 300 and the second side unit 400 is movable between various positions relative to the central unit 200, allowing the fitness equipment storage system 100 to be positioned in a space-saving closed position that may avoid common spatial limitations of gyms and fitness studios.

Figure 3:
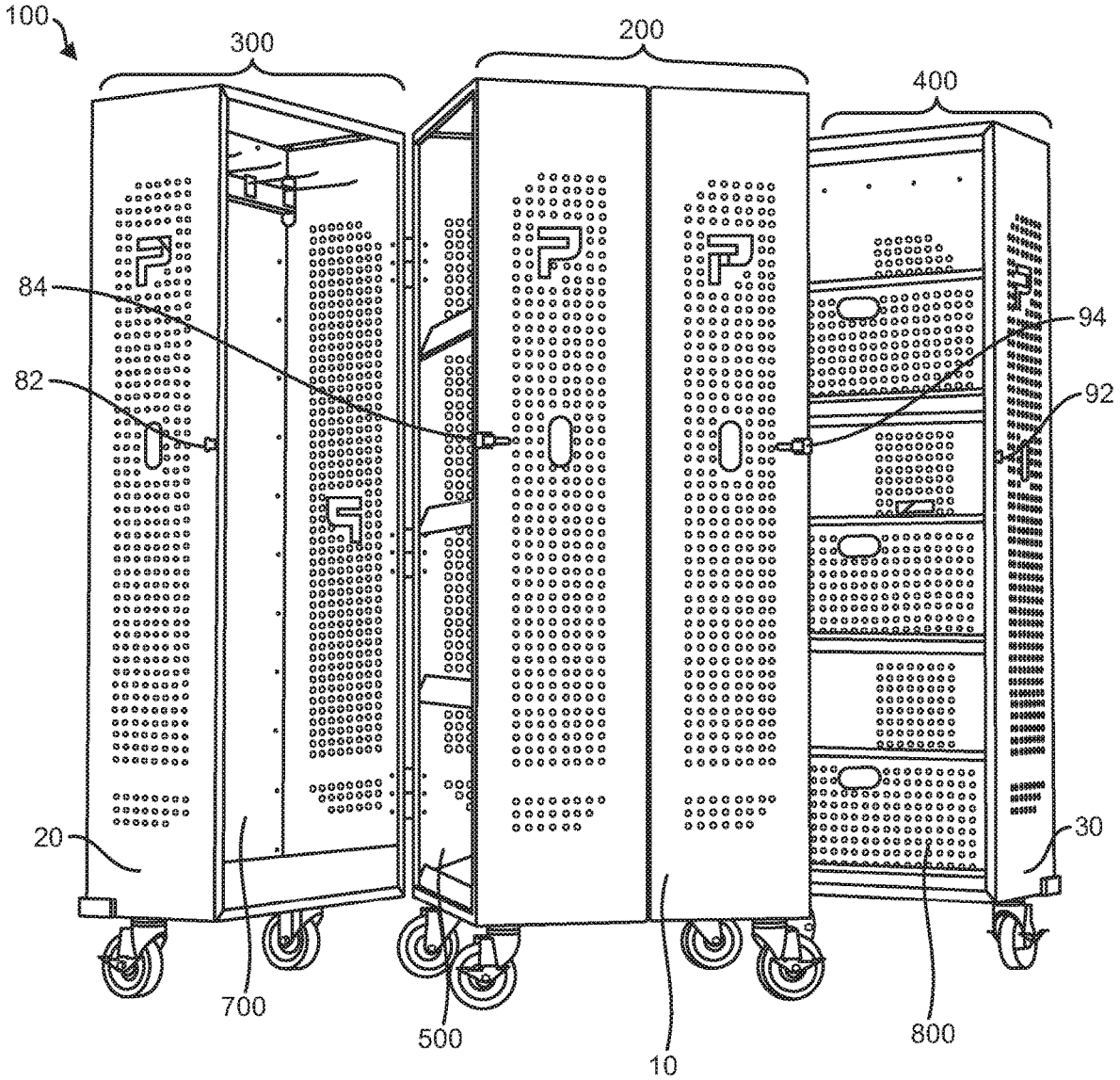
FIG. 3 is a front, left side perspective view of an embodiment of the fitness equipment storage system disclosed herein, in which each of the first and second side units is between a first position and a second position.
Figure 4:
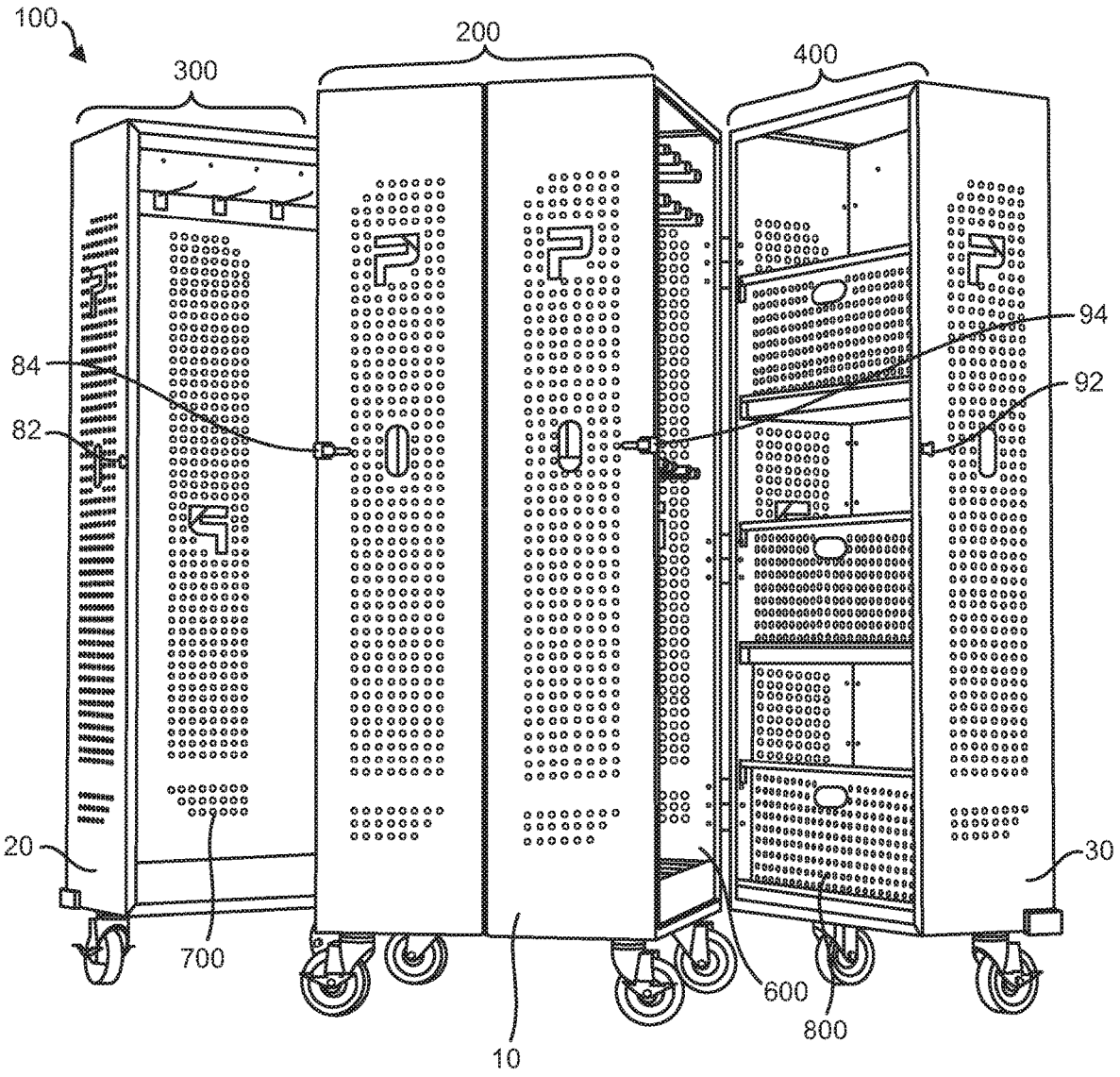
FIG. 4 is a front, right side perspective view of an embodiment of the fitness equipment storage system disclosed herein, in which each of the first and second side units is between a first position and a second position.
Figure 8A:
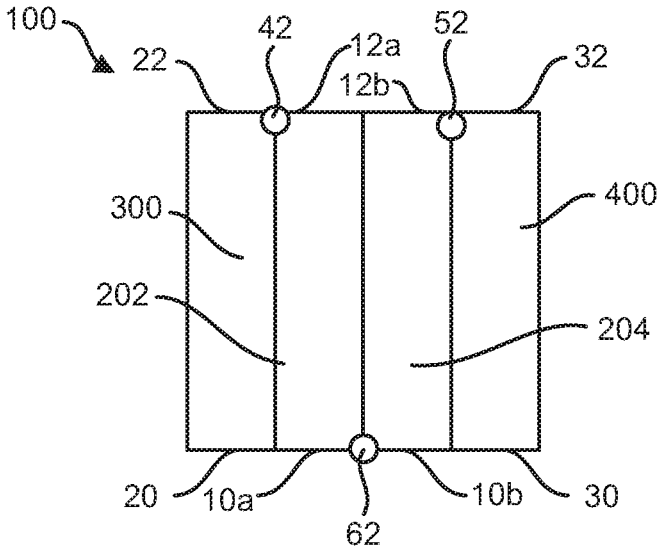
FIG. 8A is a top view of an embodiment of the fitness equipment storage system disclosed herein, in a closed (and optionally locked) orientation.

For instance, the first side unit 300 is movable between at least a first (closed) position in which the front wall 20 of the first side unit 300 is aligned with the front wall 12 of the central unit 200, whereby the first storage compartment 500 and the third storage compartment 700 face one another such that each storage compartment is inaccessible, and a second (open) position in which the front wall 20 of the first side unit 300 is substantially perpendicular to the front wall 10 of the central unit 200, whereby the first storage compartment 500 and the third storage compartment 700 are positioned substantially perpendicular to one another such that each storage compartment is accessible. Similarly, the second side unit 400 is movable between at least a first (closed) position in which the front wall 30 of the second side unit 400 is aligned with the front wall 12 of the central unit 200, whereby the second storage compartment 600 and the fourth storage compartment 800 face one another such that each storage compartment is inaccessible, and a second (open) position in which the front wall 30 of the second side unit 400 is substantially perpendicular to the front wall 12 of the central unit 200, whereby the second storage compartment 600 and the fourth storage compartment 800 are positioned substantially perpendicular to one another such that each storage compartment is accessible. FIGS. 3 and 4 show each of the first side unit 300 and second side unit 400 in transition between a first position and a second position as described above. Further, FIG. 8A shows an embodiment of a fitness equipment storage system 100 in the first position described above and FIG. 8B shows an embodiment of a fitness equipment storage system 100 in the second position described above.

The first side unit 300 and second side unit 400 may each be further movable to a third (fully open) position. In the third position, the rear wall 22 of the first side unit 300 may be adjacent to and substantially aligned with the rear wall 12 of the central unit 200. As a result, the first storage compartment 500 and the third storage compartment 700 are open in substantially the same direction such that each storage compartment is accessible. This is shown, for example, in FIG. 5. Similarly, in the third position, the rear wall 32 of the second side unit 400 may be adjacent to and substantially aligned with the rear wall 12 of the central unit 200. As a result, the second storage compartment 600 and the fourth storage compartment 800 are open in substantially the same direction such that each storage compartment is accessible. This is shown, for example, in FIG. 6. Further, FIG. 8D shows an embodiment of a fitness equipment storage system 100 in the third position described above.

In further embodiments, the fitness equipment storage system 100 may further comprise a central unit 200 having two or more hingedly connected portions. An example of such an embodiment is shown in FIGS. 7 through 8F.

Figure 7:
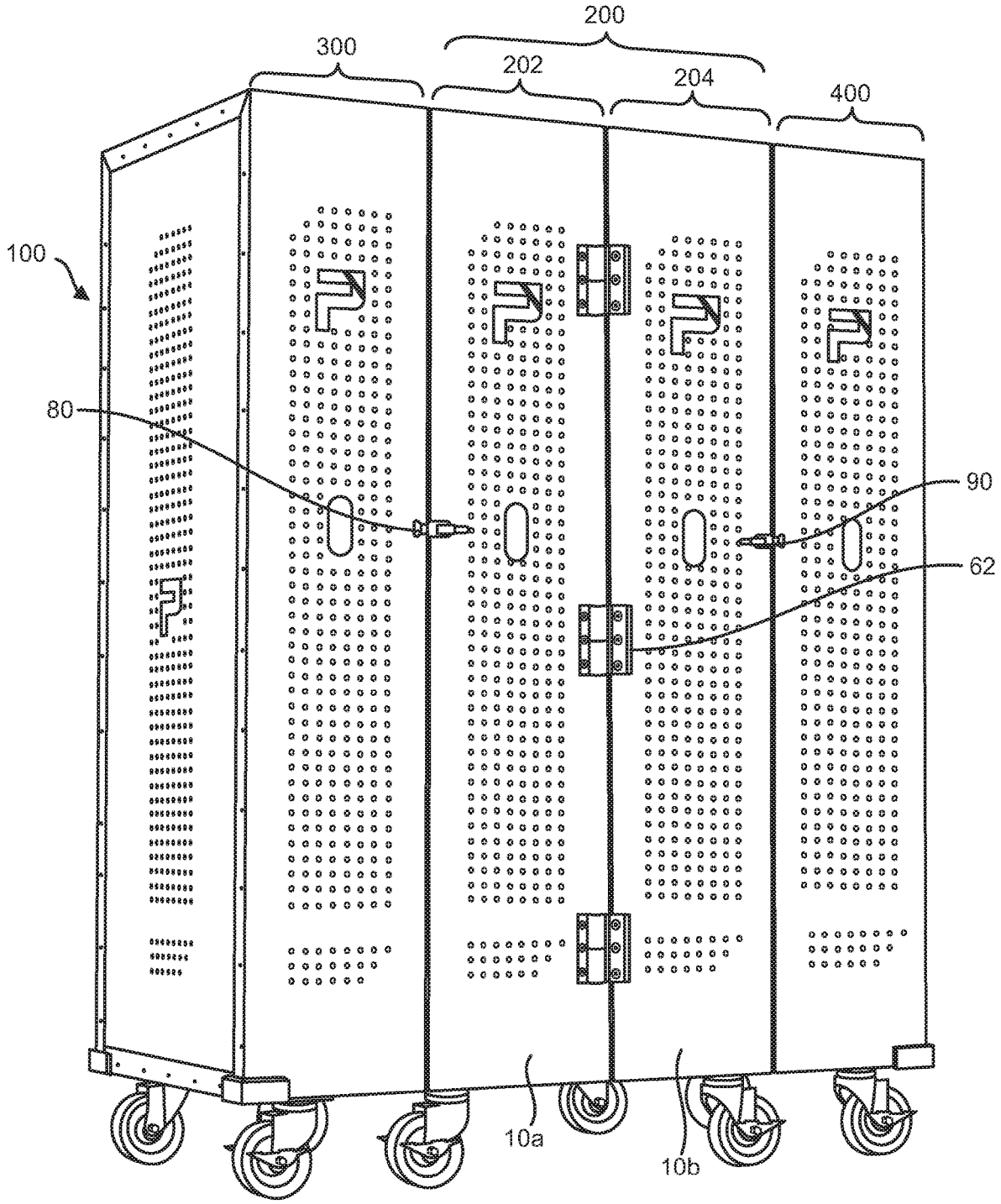
FIG. 7 shows is a front, left side perspective view of an embodiment of the fitness equipment storage system disclosed herein, in which each of the first and second side units is in a first position, and also shows the central unit having two sections which are hingedly connected.
Figure 8B:
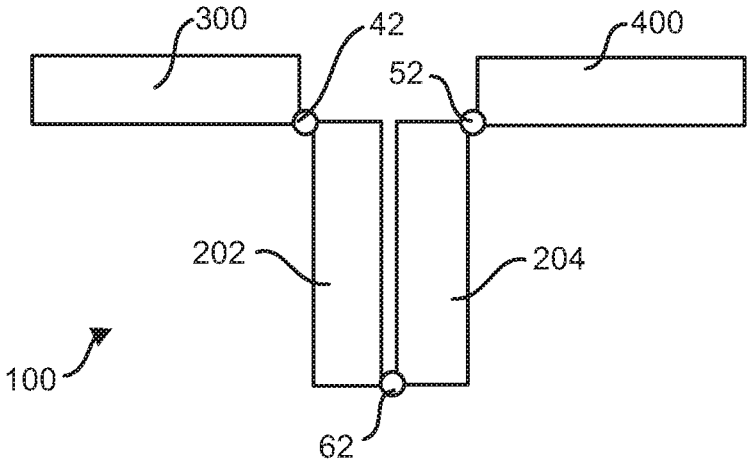
FIG. 8B is a top view of an embodiment of the fitness equipment storage system disclosed herein, in a 90-degree orientation.
Figure 8C:
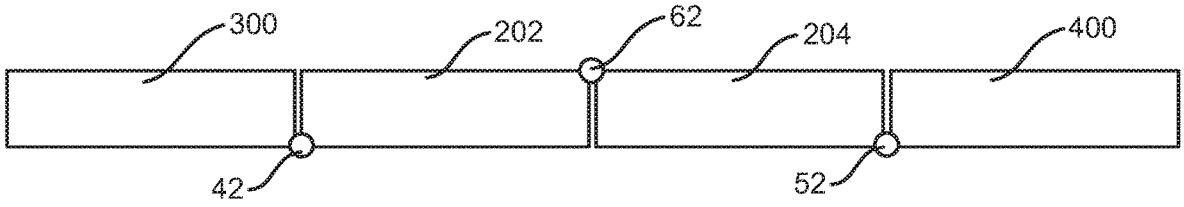
FIG. 8C is a top view of an embodiment of the fitness equipment storage system disclosed herein, in a wall orientation.
Figure 8D:
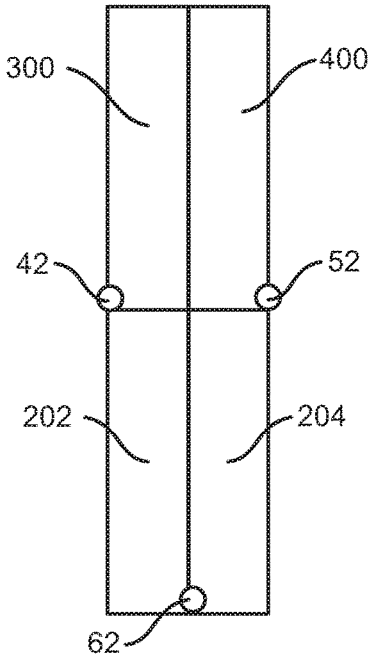
FIG. 8D is a top view of an embodiment of the fitness equipment storage system disclosed herein, in a folded back orientation.
Figure 8E:
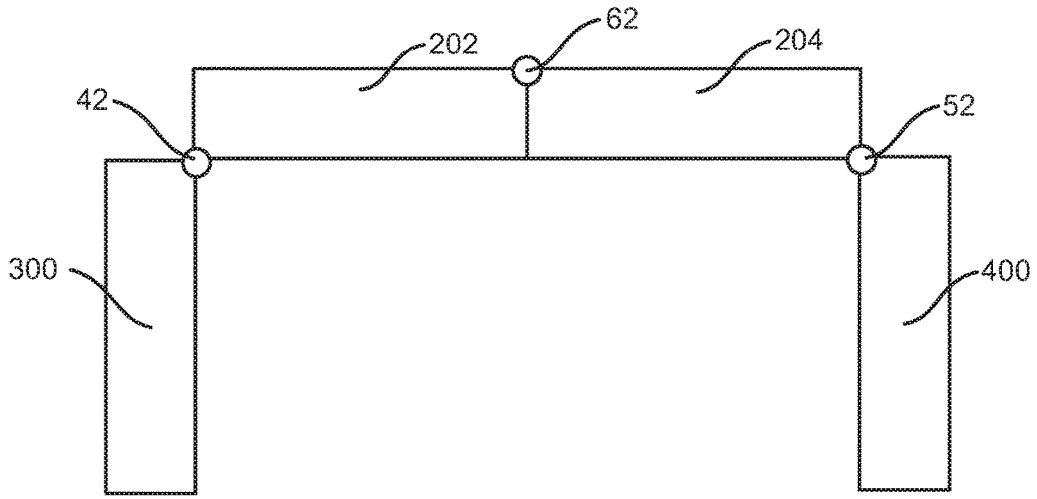
FIG. 8E is a top view of an embodiment of the fitness equipment storage system disclosed herein, in a U-shaped orientation.
Figure 8F:
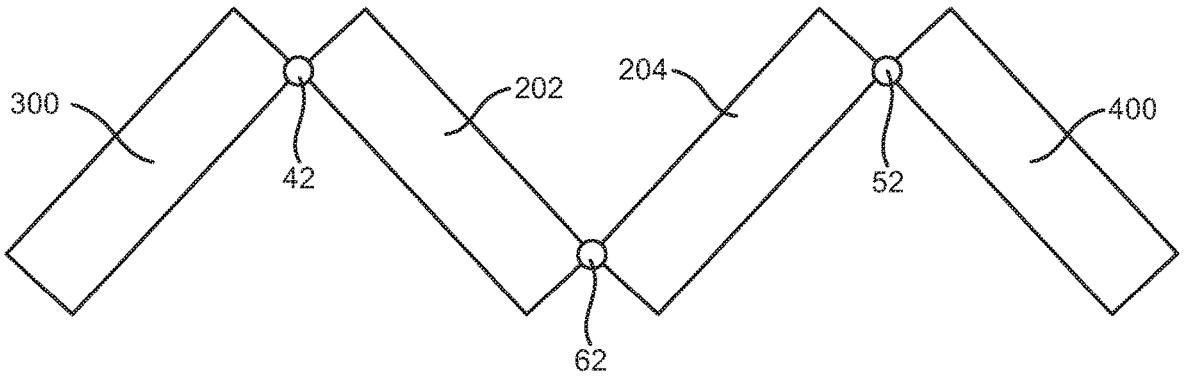
FIG. 8F is a top view of an embodiment of the fitness equipment storage system disclosed herein, in a staggered orientation.

The embodiment shown in FIGS. 7 through 8F comprises a central unit 200 having two separate sections 202,204. For instance, each of the front wall 10 of the central unit 200, the rear wall 12 of the central unit, the bottom wall 14 of the central unit, and the top wall 17 of the central unit may be made up of two distinct wall portions. Accordingly, the first storage compartment 500 is defined by a first portion of the front wall 10*a*, a first portion of the rear wall 12*a*, a first portion of the bottom wall 14*a*, a first portion of the top wall 17*a*, and a first interior wall 18*a*. Similarly, the second storage compartment 600 is defined by a second portion of the front wall 10*b*, a second portion of the rear wall 12*b*, a second portion of the bottom wall 14*b*, a second portion of the top wall 17*b*, and a second interior wall 18.

As shown in FIG. 7, the two separate wall portions 10*a*,10*b* that make up the front wall of the central unit 200 may be hingedly connected, such as via hinges 62, such that the first and second sections 202, 204 may be moved between a first position in which the first storage compartment 500 and second storage compartment 600 open in opposing directions (e.g. as shown in FIGS. 8A, 8B, and 8D) and a second position in which the first storage compartment and second storage compartment are open in substantially the same direction (e.g. as shown in FIGS. 8C and 8E). In such an embodiment, the first portion of the rear wall 12*a* may have a first latching element and the second portion of the rear wall 12*b* may have a second latching element, the first and second latching elements being configured to mate so as to prevent movement of the first and second portions 202, 204 away from a first position. Such a latching mechanism may, for example, serve to prevent undesired movement of first and second portions 202, 204 away from each other.

By dividing the central unit 200 into first and second portions 202, 204, fitness equipment storage system 100 may be placed into a variety of additional orientations, providing enhanced flexibility for gyms, fitness studios, and the like. For instance, when the central unit 200 is made up of two separate portions 202,204 that are moveable relative to one another, the first storage compartment 500, second storage compartment 600, third storage compartment 700, and fourth storage compartment 800 may be positioned to all open in substantially the same direction such that each storage compartment is accessible along a single wall, as shown in FIG. 8C. The storage compartments may also be positioned to open in a U-shaped orientation, such as a user standing within the "U" may have access to fitness equipment located to the front (first and second storage compartments 500 and 600), to the left (storage compartment 700), and to the right (storage compartment 800), as shown in FIG. 8E. The storage compartments may also be positioned to open in two, side-by-side V-shaped orientations, as shown in FIG. 8F.

FIGS. 8A-8F provide a top-down view showing the various configurations into which the fitness equipment storage system 100 mat be placed. The hinged connections between units (42,52,62) are designated by circles in the Figures. A system 100 that can adopt a variety of positions can effectively utilize small or awkward spaces and can provides easy access to the fitness equipment stored therein.

FIG. 8A depicts the fitness equipment storage system 100 in a closed position, which can be optionally locked to restrict access. FIG. 8B depicts fitness equipment storage system 100 in an open position in which where units 202/300 and 204/400 form a 90-degree orientation. FIG. 8C depicts an open, wall orientation configuration, where all compartments open in substantially the same direction. FIG. 8D depicts each of the first side unit 300 and second side unit 400 in a folded back open orientation. FIG. 8E shows a U-shaped orientation, in which the first and second portions 202, 204 of central unit 200 have been rotated to open in the same direction and in which each of the first side unit 300 and second side unit 400 is rotated to be perpendicular with central unit. FIG. 8F shows a staggered orientation of the compartments, in which each unit forms an angle of about 45 degrees with each adjacent unit. Other, non-illustrated configurations are also contemplated, as would be readily understandable based on those shown in FIGS. 8A through 8F.

In some embodiments of the fitness equipment storage system 100, one or more of storage compartment 500, second storage compartment 600, third storage compartment 700, and fourth storage compartment 800 may be configured to accommodate a particular type of exercise equipment.

In some embodiments, for instance, at least one of the first storage compartment 500, second storage compartment 600, third storage compartment 700, and fourth storage compartment 800 is configured to store a plurality of dumbbells. For example, the rear/interior wall of a storage compartment may comprise pegs or hooks that project outwardly and which are configured to support the handles of dumbbells. Each set of pegs/hooks may be sized and spaced equally, or pegs/hooks may be of varying sizes and/or spacings so as to support dumbbells having different dimensions, such as may be the case for a range of relatively low-weight to relatively high-weight dumbbells. Where a variety of differently weighted dumbbells are to be stored, the storage compartment may include an indication that heavier dumbbells are stored below lighter dumbbells.

In some embodiments, at least one of the first storage compartment 500, second storage compartment 600, third storage compartment 700, and fourth storage compartment 800 is configured to store a plurality of resistance bands, resistance tubing, jump ropes, or a combination thereof. For example, the rear/interior wall of a storage compartment may comprise a plurality of pegs or hooks on which the resistance bands, resistance tubing, jump ropes, or the like can be hung.

In some embodiments, at least one of the first storage compartment 500, second storage compartment 600, third storage compartment 700, and fourth storage compartment 800 is configured to store a plurality of exercise mats. For example, the rear/interior wall of a storage compartment may comprise a plurality of shelves, optionally containing front faces, onto which loosely rolled exercise mats may be placed.

In some embodiments, at least one of the first storage compartment 500, second storage compartment 600, third storage compartment 700, and fourth storage compartment 800 is configured to store a plurality of boxing gloves. For example, the rear/interior wall of a storage compartment may comprise a plurality of shelves, optionally containing front faces, onto which boxing gloves may be placed. Alternatively, the rear/interior wall of a storage compartment may comprise a plurality of pegs/hooks onto which boxing gloves may be hung.

Figure 5:
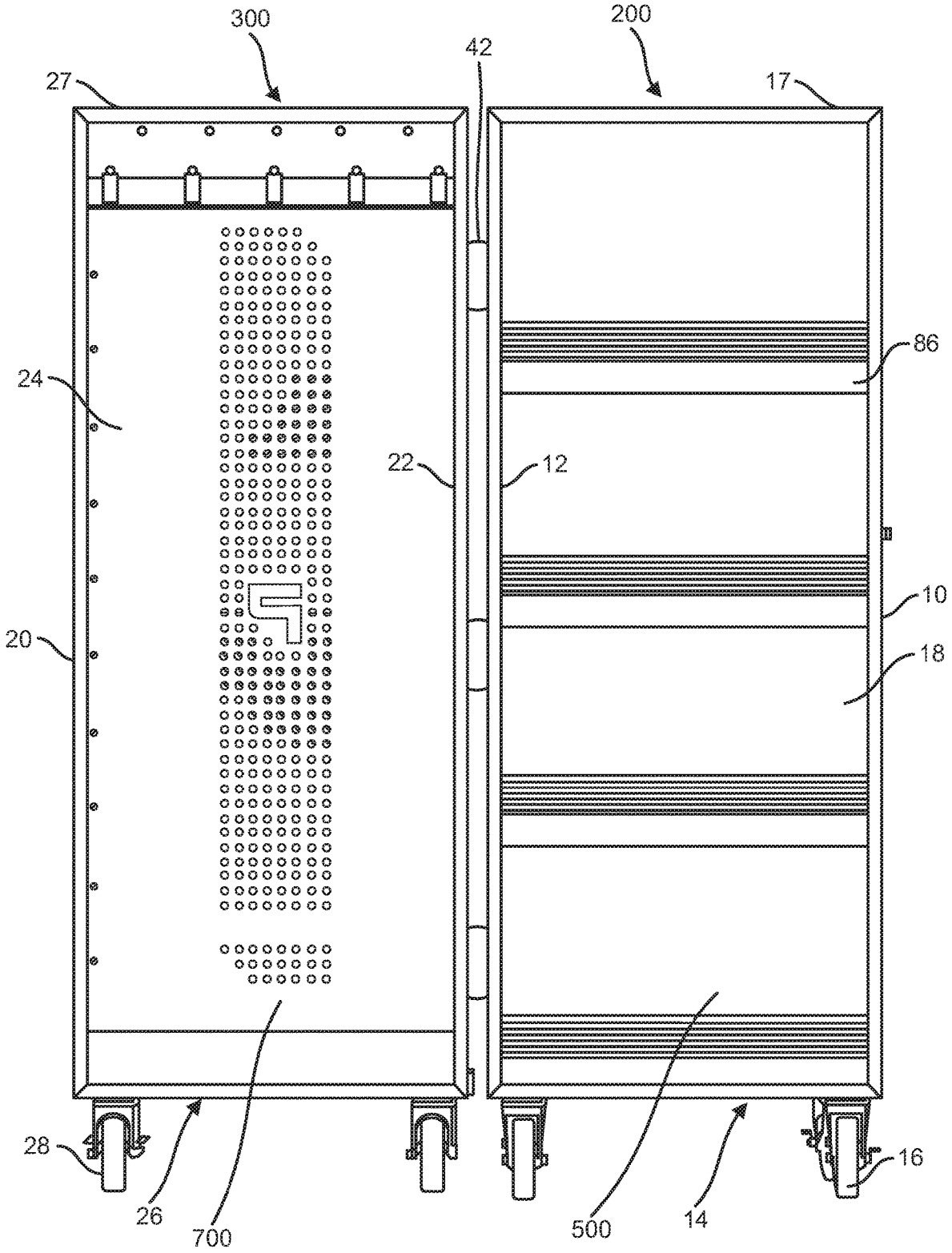
FIG. 5 is a left side elevation view of an embodiment of the fitness equipment storage system disclosed herein, in which the first side unit is in a third position, showing the interiors of the first and third storage compartments.
Figure 6:
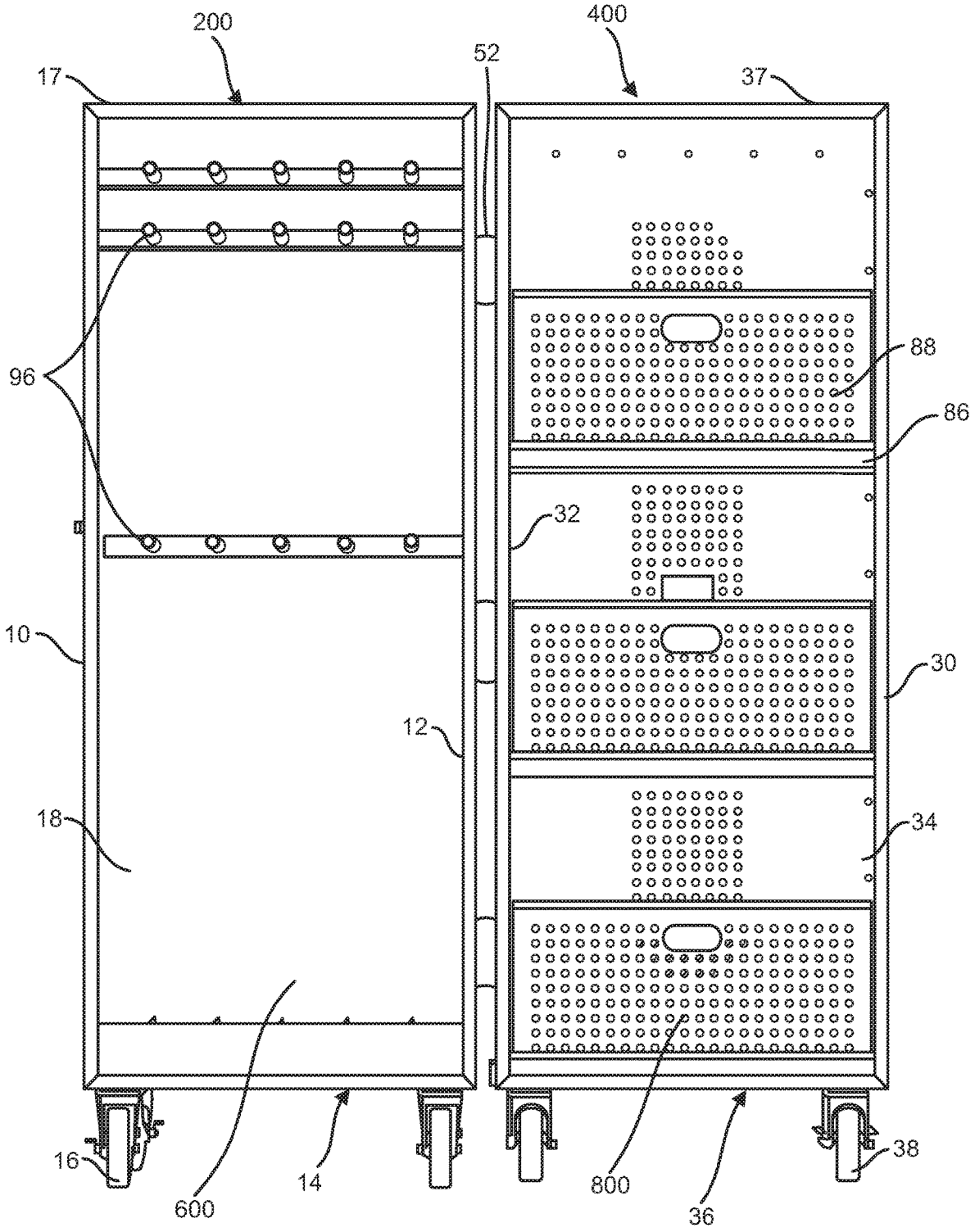
FIG. 6 is a right side elevation view of an embodiment of the fitness equipment storage system disclosed herein, in which the second side unit is in a third position, showing the interiors of the second and fourth storage compartments.
Figure 9:
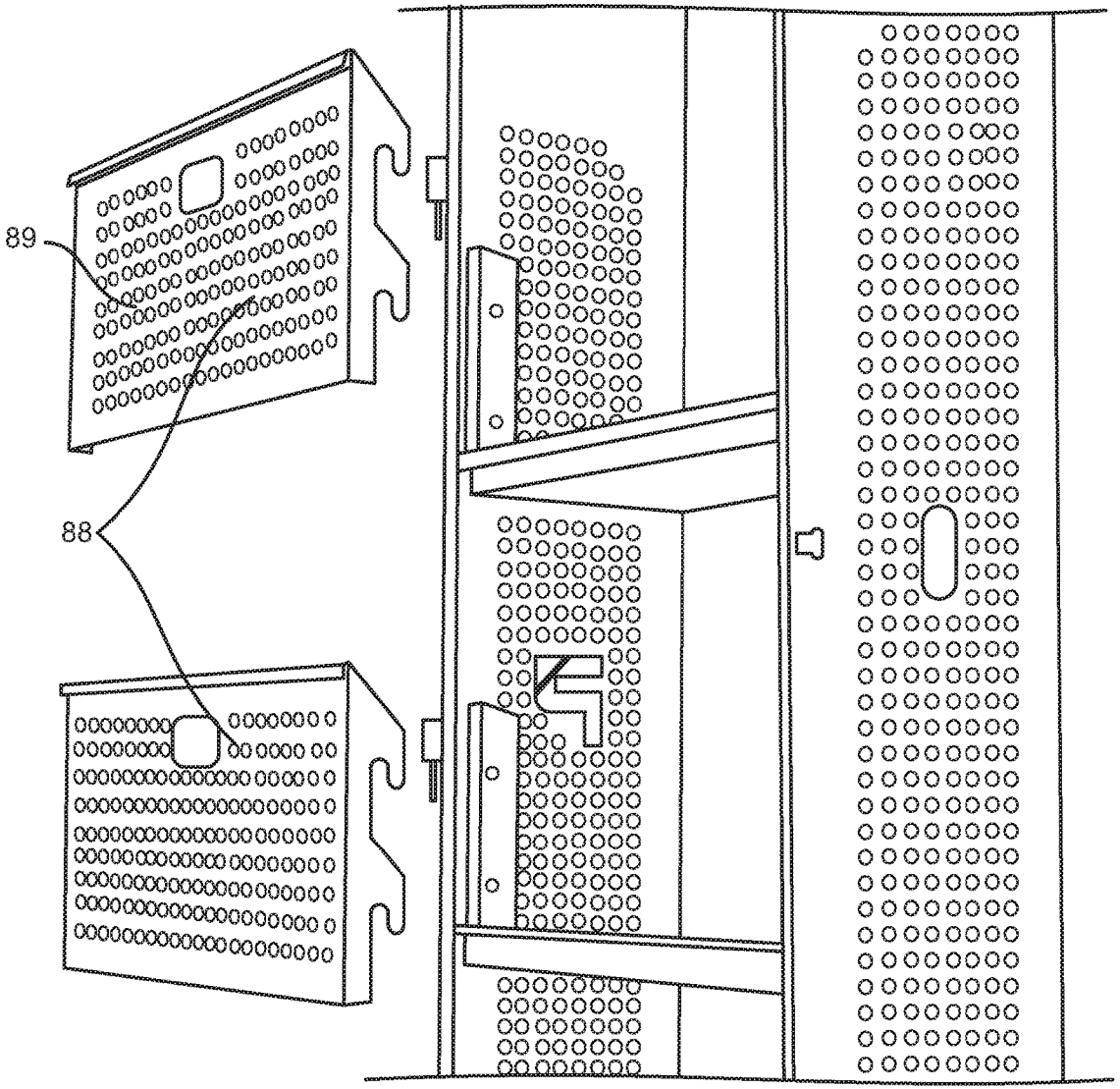
FIG. 9 is a perspective view of an embodiment of a storage compartment comprising removable shelving front faces.

In some embodiments, the interiors of at least one of the first storage compartment 500, second storage compartment 600, third storage compartment 700, and fourth storage compartment 800 may contain shelves 86, such as those shown in FIGS. 5 and 6 or pegs and/or hooks 96 such as those shown in FIG. 6. One or more of the shelves 86 may comprise a plurality of apertures, thereby providing increased airflow to the fitness equipment stored thereon. In some embodiments, the shelves 86 may comprise front faces 88. The front faces 88 of the shelves may have a plurality of apertures 89, which may provide the same airflow and/or visibility benefits described above. Moreover, in some embodiments, the shelves may have front faces 88 that are removable, as shown for example in FIG. 9, providing additional options for how a gym or fitness studio wishes to utilize the fitness equipment storage system 100.

It can be seen that the described embodiments provide unique and novel storage systems having a number of advantages over those in the art. While there is described herein certain specific elements embodying the invention, it will be manifest to those skilled in the art that various modifications and rearrangements of the elements may be made without departing from the spirit and scope of the underlying inventive concept and that the same is not limited to the particular forms herein shown and described except insofar as indicated by the scope of the appended claims.

What is claimed:

1. A fitness equipment storage system comprising:

a. a central unit comprising a front wall, a rear wall, a bottom wall comprising one or more wheels, and one or more interior walls, the central unit defining a first storage compartment open to a first side of the central unit and a second storage compartment open to a second side of the central unit;

b. a first side unit comprising a front wall, a rear wall, an outer side wall, and a bottom wall comprising one or more wheels, the first side unit defining a third storage compartment;

wherein the rear wall of the first side unit is hingedly connected to a first side of the rear wall of the central unit, such that the first side unit is movable between at least a first position in which the front wall of the first side unit is aligned with the front wall of the central unit, whereby the first storage compartment and the third storage compartment face one another such that each storage compartment is inaccessible, and a second position in which the front wall of the first side unit is substantially perpendicular to the front wall of the central unit, whereby the first storage compartment and the third storage compartment are positioned substantially perpendicular to one another such that each storage compartment is accessible; and c. a second side unit comprising a front wall, a rear wall, an outer side wall, and a bottom wall comprising one or more wheels, the second side unit defining a fourth storage compartment;

wherein the rear wall of the second side unit is hingedly connected to a second side of the rear wall of the central unit, such that the second side unit is movable between at least a first position in which the front wall of the second side unit is aligned with the front wall of the central unit, whereby the second storage compartment and the fourth storage compartment face one another such that each storage compartment is inaccessible, and a second position in which the front wall of the second side unit is substantially perpendicular to the front wall of the central unit, whereby the second storage compartment and the fourth storage compartment are positioned substantially perpendicular to one another such that each storage compartment is accessible;

wherein the front and rear walls of the first and second side units are each about half as wide as the front and rear walls of the central unit;

wherein the first side unit is further movable to a third position, in which the rear wall of the first side unit is adjacent to and substantially aligned with the rear wall of the central unit, whereby the first storage compartment and the third storage compartment are open in substantially the same direction such that each storage compartment is accessible; and the second side unit is further movable to a third position, in which the rear wall of the second side unit is adjacent to and substantially aligned with the rear wall of the central unit, whereby the second storage compartment and the fourth storage compartment are open in substantially the same direction such that each storage compartment is accessible; and wherein the central unit comprises two separate portions that are moveable relative to one another, such that the first, second, third, and fourth storage compartments may be positioned to all open in substantially the same direction such that each storage compartment is accessible.

2. The fitness equipment storage system of claim 1, wherein the front wall of the first side unit comprises a first latching element and the front wall of the central unit comprises a second latching element, the first and second latching elements being configured to mate so as to prevent movement of the first side unit away from its first position; and the front wall of the second side unit comprises a first latching element and the front wall of the central unit comprises a second latching element, the first and second latching elements being configured to mate so as to prevent movement of the second side unit away from its first position.

3. The fitness equipment storage system of claim 1, wherein the central unit comprises four wheels, the first side unit comprises two wheels, and the second side unit comprises two wheels.

4. The fitness equipment storage system of claim 1, wherein the walls of each of the central unit, the first side unit, and the second side unit are metal.

5. The fitness equipment storage system of claim 4, wherein at least the front walls and the rear walls of each of the central unit, the first side unit, and the second side unit comprise a plurality of apertures.

6. The fitness equipment storage system of claim 5, wherein the apertures are located along at least 75% of the height of the front and rear walls.

7. The fitness equipment storage system of claim 5, wherein the outer side wall of the first side unit and the outer side wall of the second side unit each comprise a plurality of apertures.

8. The fitness equipment storage system of claim 7, wherein the apertures are located along at least 75% of the height of the front walls, the rear walls, and the two outer side walls.

9. The fitness equipment storage system of claim 1, wherein at least one of the first, second, third, and fourth storage compartments is configured to store a plurality of dumbbells.

10. The fitness equipment storage system of claim 1, wherein at least one of the first, second, third, and fourth storage compartments is configured to store a plurality of resistance bands, resistance tubing, jump ropes, or a combination thereof.

11. The fitness equipment storage system of claim 1, wherein at least one of the first, second, third, and fourth storage compartments is configured to store a plurality of exercise mats.

12. The fitness equipment storage system of claim 1, wherein at least one of the first, second, third, and fourth storage compartments is configured to store a plurality of boxing gloves.

13. A fitness equipment storage system comprising:

a. a central unit comprising a front wall, a rear wall, a bottom wall comprising one or more wheels, and one or more interior walls, the central unit defining a first storage compartment open to a first side of the central unit and a second storage compartment open to a second side of the central unit;

b. a first side unit comprising a front wall, a rear wall, an outer side wall, and a bottom wall comprising one or more wheels, the first side unit defining a third storage compartment;

wherein the rear wall of the first side unit is hingedly connected to a first side of the rear wall of the central unit, such that the first side unit is movable between at least a first position in which the front wall of the first side unit is aligned with the front wall of the central unit, whereby the first storage compartment and the third storage compartment face one another such that each storage compartment is inaccessible, and a second position in which the front wall of the first side unit is substantially perpendicular to the front wall of the central unit, whereby the first storage compartment and the third storage compartment are positioned substantially perpendicular to one another such that each storage compartment is accessible; and c. a second side unit comprising a front wall, a rear wall, an outer side wall, and a bottom wall comprising one or more wheels, the second side unit defining a fourth storage compartment;

wherein the rear wall of the second side unit is hingedly connected to a second side of the rear wall of the central unit, such that the second side unit is movable between at least a first position in which the front wall of the second side unit is aligned with the front wall of the central unit, whereby the second storage compartment and the fourth storage compartment face one another such that each storage compartment is inaccessible, and a second position in which the front wall of the second side unit is substantially perpendicular to the front wall of the central unit, whereby the second storage compartment and the fourth storage compartment are positioned substantially perpendicular to one another such that each storage compartment is accessible; wherein each of the front wall of the central unit, the rear wall of the central unit, and the bottom wall of the central unit are made up of two separate wall portions;

the first storage compartment is defined by a first portion of the front wall, a first portion of the rear wall, a first portion of the bottom wall, and a first interior wall;

the second storage compartment is defined by a second portion of the front wall, a second portion of the rear wall, a second portion of the bottom wall, and a second interior wall; and wherein the two separate wall portions that make up the front wall of the central unit are hingedly connected, such that the first and second storage compartments may be moved between a first position in which the first and second storage compartments are open in opposing directions, and a second position in which the first and second storage compartments are open in substantially the same direction; and wherein the first, second, third, and fourth storage compartments may all be positioned to all open in substantially the same direction.

14. The fitness equipment storage system of claim 13, wherein a first portion of the rear wall comprises a first latching element and the second portion of the rear wall comprises a second latching element, the first and second latching elements being configured to mate so as to prevent movement of the first and second storage compartments away from the first position.

15. The fitness equipment storage system of any claim 1, wherein at least one of the first, second, third, and fourth storage compartments comprises shelves having removable front faces.

* * * * *